US007458296B2

(12) United States Patent
Richter et al.

(10) Patent No.: US 7,458,296 B2
(45) Date of Patent: Dec. 2, 2008

(54) SCREWING TOOL WITH INTERCHANGEABLE BLADE

(75) Inventors: Ralf-Richard Richter, Wuppertal (DE); Carsten Wulf, Wuppertal (DE)

(73) Assignee: Wera Werk Hermann Werner GmbH & Co. KG (DE)

( * ) Notice: Subject to any disclaimer, the term of this patent is extended or adjusted under 35 U.S.C. 154(b) by 0 days.

(21) Appl. No.: 11/857,664

(22) Filed: Sep. 19, 2007

(65) Prior Publication Data

US 2008/0047404 A1 Feb. 28, 2008

Related U.S. Application Data

(63) Continuation of application No. PCT/EP2006/050654, filed on Feb. 3, 2006.

(51) Int. Cl.
*B25B 23/16* (2006.01)
*B25G 3/22* (2006.01)

(52) U.S. Cl. ..... 81/438; 81/177.2

(58) Field of Classification Search ..... 81/438, 81/177.85, 177.2
See application file for complete search history.

(56) References Cited

U.S. PATENT DOCUMENTS

| | | | | |
|---|---|---|---|---|
| 873,625 | A | 12/1907 | Starrett | |
| 2,674,286 | A | 4/1954 | Carson | |
| 4,466,377 | A * | 8/1984 | Kolb et al. | 16/422 |
| 5,836,223 | A | 11/1998 | Lin | |
| 6,840,143 | B1 * | 1/2005 | Lin | 81/438 |
| 2005/0045001 | A1 * | 3/2005 | Huang | 81/177.85 |
| 2005/0045002 | A1 * | 3/2005 | Cluthe | 81/177.85 |

FOREIGN PATENT DOCUMENTS

| | | |
|---|---|---|
| DE | 1 861 500 | 10/1962 |
| DE | 44 47 503 | 11/1995 |
| DE | 297 12 534 | 9/1997 |
| DE | 298 10 657 | 10/1998 |
| DE | 102 33 866 | 2/2004 |
| DE | 20 2004 002440 | 9/2004 |
| FR | 2 702 172 | 9/1994 |

OTHER PUBLICATIONS

International Search Report, Mar. 29, 2006, 3 pages.

* cited by examiner

*Primary Examiner*—David B Thomas
(74) *Attorney, Agent, or Firm*—St. Onge Steward Johnston & Reens LLC

(57) ABSTRACT

The invention relates to a tool, especially a screwing tool having a handle with a chuck, and a blade, especially a screwdriver blade, that can be inserted into an insertion opening of the chuck. The blade inserted into the insertion opening is held by a detent of the chuck, said detent being displaced from a detent position to a release position by actuating a trigger. The inventive tool is characterized in that the detent comprises a detent projection which is located on a spring arm that extends in the axial direction of the insertion opening and on the periphery thereof. Said spring arm is displaced by a control element of the trigger that can be displaced in the axial direction from the detent position to the release position. The insertion opening is configured by an insertion cylinder located in a cavity of the handle. The insertion cylinder is produced from plastic and the spring arm is associated with the insertion cylinder in order to form a single part consisting of the same material.

15 Claims, 4 Drawing Sheets

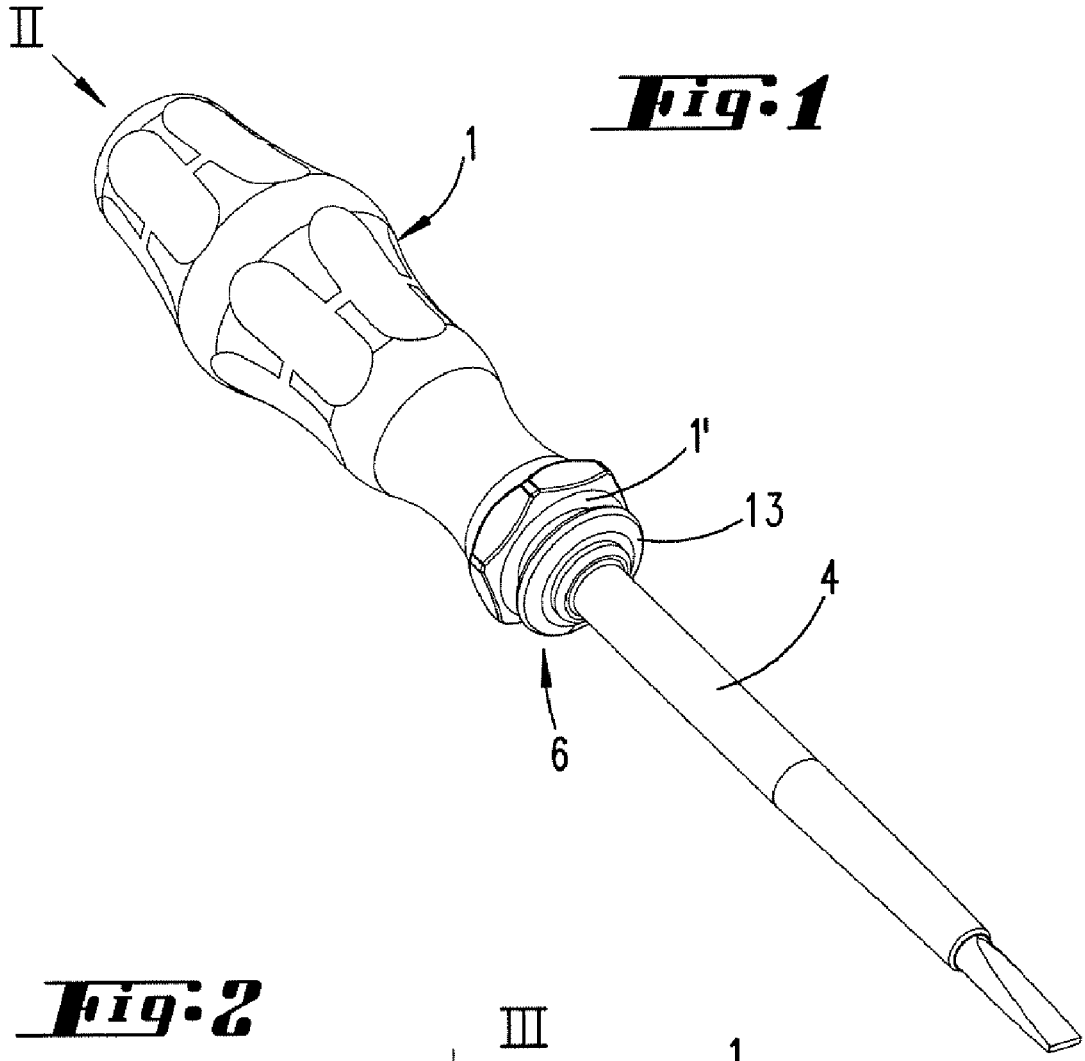
Fig. 1
Fig. 2
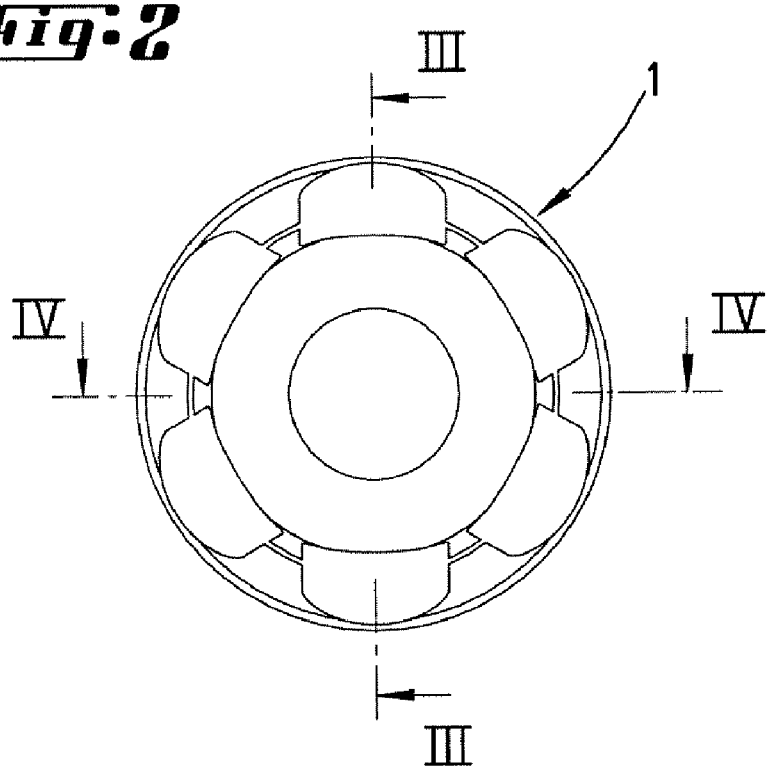

SCREWING TOOL WITH INTERCHANGEABLE BLADE

CROSS-REFERENCE TO RELATED APPLICATIONS

The present application is a continuation of pending International patent application PCT/EP2006/050654 filed on Feb. 3, 2006 which designates the United States and claims priority from German patent application 10 2005 012 729.0 filed on Mar. 19, 2005, the content of which is incorporated herein by reference.

FIELD OF THE INVENTION

The invention relates to a tool, in particular screwing tool, having a handle with a chuck, and having a blade, in particular a screwdriver blade, which can be plugged into a plug-in opening of the chuck, the blade, plugged into the plug-in opening, being retained by a catch of the chuck, which catch can be displaced from a latching position into a release position by actuation of a trigger.

BACKGROUND OF THE INVENTION

A screwing tool of the type mentioned above is already known from DE 1861500. The screwing-tool handle described in this document forms a lateral button which acts on a slide which can be displaced radially in relation to the axis of the blade. This slide has a window through which the blade projects. The blade has a latching recess into which a peripheral portion of the window projects in the latching position.

U.S. Pat. No. 873,625 describes a similar latching mechanism on a screwing tool. U.S. Pat. No. 2,674,286 also describes a screwing tool with a handle into which is plugged a blade which is retained in a latching position by a catch. The blade has a radial recess which accommodates the periphery of a window which is associated with a slide which can be displaced counter to the restoring force of a spring.

DE 202004002440 U1 describes a handle with a plug-in cavity into which a screwdriver-blade portion sheathed in plastics material can be plugged. The plug-in portion of the screwdriver blade, here too, engages through a window of a slide, which can be displaced radially counter to the restoring force of springs. This slide can be displaced, by push-button actuation, from a latching position into a release position.

SUMMARY OF THE INVENTION

Taking the abovementioned prior art as a departure point, it is an object of the invention to develop the tool of the generic type such that it is easier to produce and is functionally advantageous.

The object is achieved by the invention specified in the claims. Each claim relates to an independent solution. Each claim can be combined as desired with any other claim.

Claim 1 provides, first and foremost, that the catch has a latching protrusion which is disposed on a spring arm, the spring arm extending in the axial direction of the plug-in opening and along the periphery of the latter, and the latching protrusion can be displaced from the latching position into the release position by a control element of the axially displaceable trigger. Release of the catch is effected, in the case of the subject matter specified in Claim 1, by the trigger being activated in the direction in which the blade extends. The chuck preferably has a plug-in sleeve which is plugged into the cavity of the handle. It is also possible, however, for this plug-in sleeve to be encapsulated by injection molding during production of the plastics-material handle. Radial protrusions and, in particular, retaining ribs are provided in order to secure the plug-in sleeve in a rotationally fixed manner in the handle. In a development of the invention, it is provided that the spring arm, which forms the latching protrusion, is associated integrally with the plug-in sleeve. The plug-in sleeve and the spring arms formed integrally thereon are thus preferably produced from a highly elastic plastics material, in particular POM. The spring arm preferably has a slope. This slope is preferably a control slope and interacts with the control element. The latter may be formed by an axial extension of an annular body formed by the trigger. This annular body may incorporate a through-opening through which the blade projects. The control slopes may preferably be associated with the latching protrusion. They also serve to be displaced radially outward by the end of the blade when the latter is plugged in to the plug-in opening. They then snap into an annular recess of the blade in order to retain the latter in the plug-in cavity counter to axial withdrawal forces. In order to increase the retaining force, it may further be provided that the latching step of the latching protrusion is undercut. In a development of the invention, it is provided that retaining arms project from the annular body. These retaining arms project into a plug-in passageway of the plug-in sleeve. The radially outwardly oriented wall of this passageway may be formed by the wall of the handle cavity. In particular this retaining passageway is preferably formed by a groove of the outer wall of the plug-in sleeve. At its end, the retaining arm preferably has a hook which, in the forward position of the trigger, is located in front of a retaining step and, during the axial displacement of the trigger, moves within the passageway and shifts away from the retaining step in the process. The annular body is preferably forced into a forward position by the force of the spring arm. In this respect, the spring-arm control slope, which is preferably associated with the latching protrusion, serves not just for moving the spring out, by the axial displacement of the trigger, into a rear, radially outwardly directed escape space. By virtue of the spring-arm stressing force applied in the process, it also serves to displace the trigger back again into the starting position. In a development of the invention, it is provided that the blade comprises a core which preferably has a round cross-section and, at its free end, has a screwing tip and for the most part, in particular over its portion which plugs into the plug-in opening, is sheathed entirely in an insulating material, in particular plastics material. This configuration gives a voltage-protected screwing tool with interchangeable blades. The insulating action is further enhanced by the chuck as a whole, rather than having any metal parts, comprising exclusively plastics-material parts. The plastics-material sheath of the blade incorporates an annular recess into which the latching protrusion engages.

BRIEF DESCRIPTION OF THE DRAWINGS

Exemplary embodiments will be described hereinbelow with reference to accompanying drawings, in which:

FIG. 1 shows, in perspective illustration, a handle with plugged-in blade,

FIG. 2 shows an end view of the handle,

DETAILED DESCRIPTION OF THE INVENTION

Figure 3:
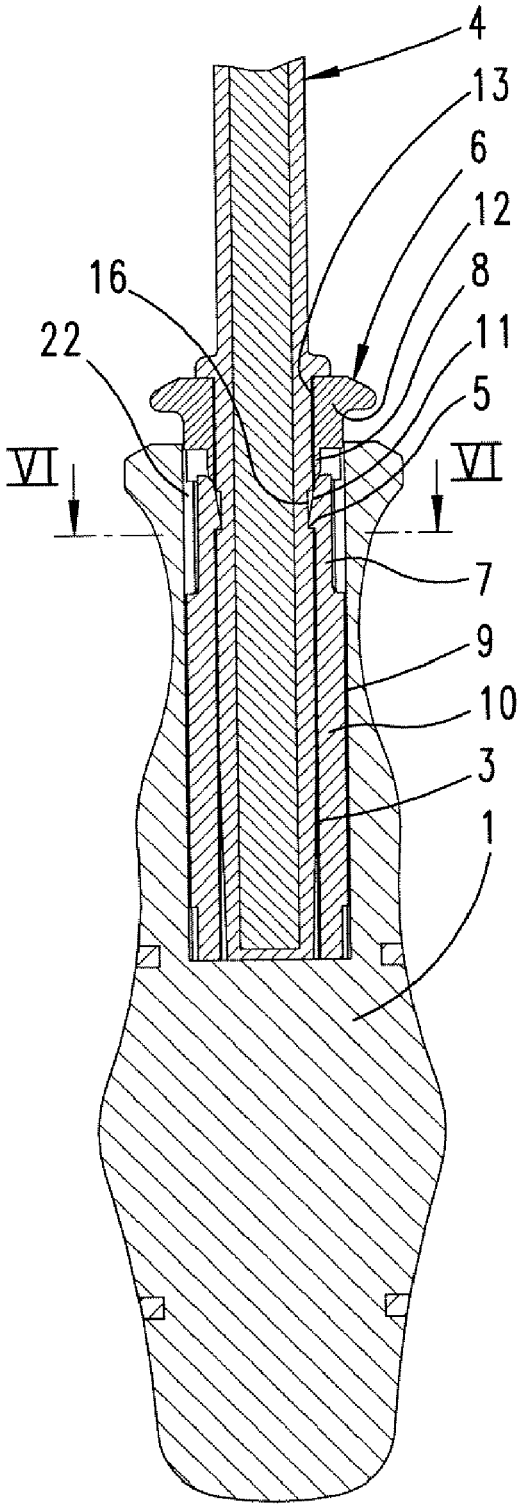
FIG. 3 shows a longitudinal section, along section lines III-III, through the handle illustrated in FIG. 1, in the latching position.
Figure 4:
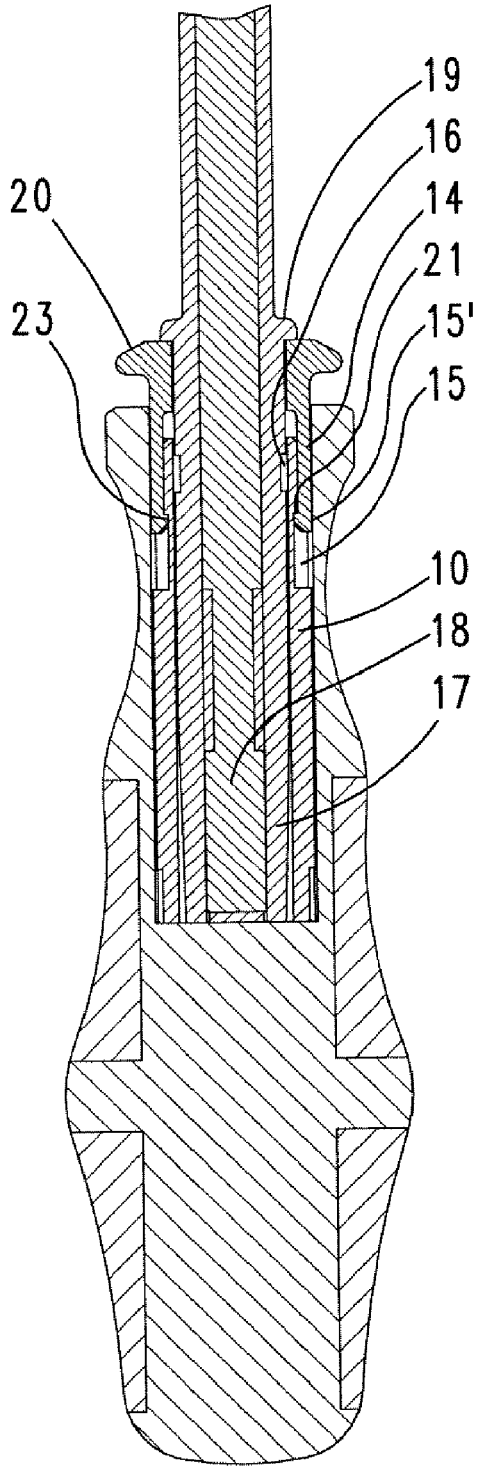
FIG. 4 shows a section along line IV-IV in FIG. 2, likewise in the latching position.
Figure 5:
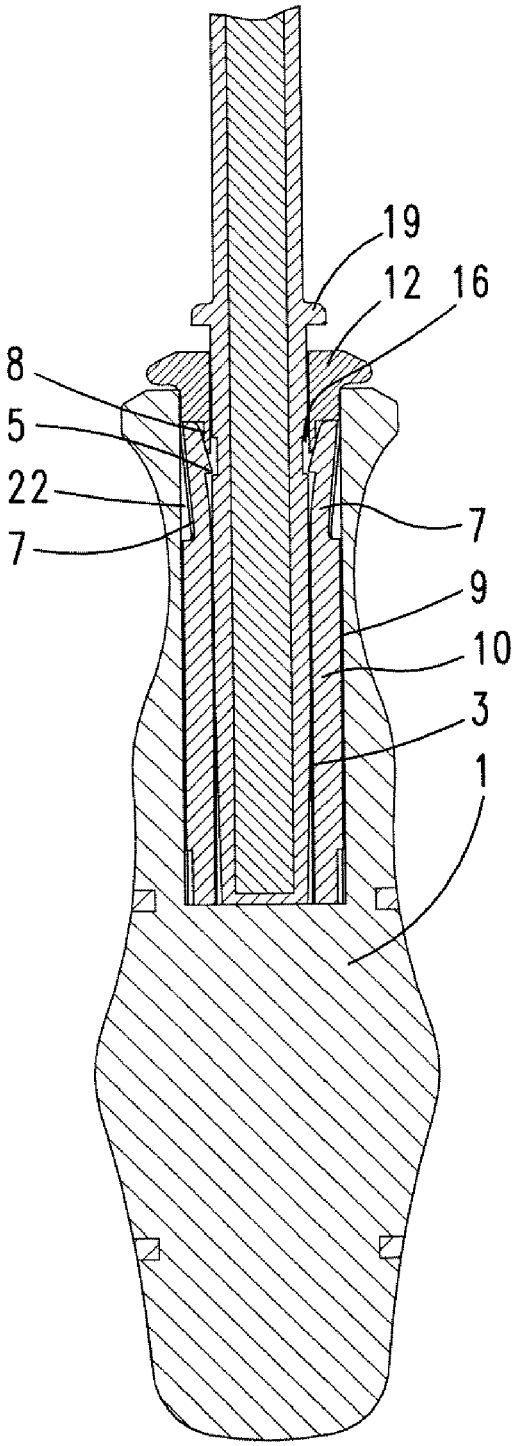
FIG. 5 shows an illustration according to FIG. 3 in the release position.

The exemplary embodiment is an electrically insulated screwdriver with interchangeable blades. It has a handle 1 with a cavity 9 which extends in the axial direction of the handle 1 and opens out at the end side 1'.

A plug-in sleeve 10 of a chuck 2 is plugged into the cavity 9 of the handle 1. The chuck 2 comprises this plug-in sleeve 10 and a trigger 6. The trigger 6 and plug-in sleeve 10, and also the handle 1, are produced from plastics material, so that the handle with the chuck 2 does not have any metal parts.

The plug-in sleeve 10 which plugs into the cavity 9 of the handle, has a plug-in opening 3 into which the blade 4 can be plugged. This plug-in opening 3 has a hexagonal cross-section. On its outer wall, the plug-in sleeve 10 forms retaining ribs 25 which are accommodated in corresponding retaining grooves of the wall of the cavity 9 in order for the plug-in sleeve to be retained in a rotationally fixed manner in the cavity 9 of the handle 1.

In its region adjacent to the opening, the plug-in sleeve 10 incorporates a passageway 15 which forms a retaining step 21, a hook 23 of a retaining arm 14 engaging behind this retaining step 21. The retaining arm 14 is associated with an annular body 12. The groove which forms the passageway 15 is closed by a wall portion of the cavity 9. This wall portion forms a wall 15' of the passageway 15 in which the retaining arm 14 can be displaced in the axial direction of the handle 1.

Extending in a position which is offset through 90 degrees in relation to the two diametrically opposite passageways 15 are two spring arms 7, which are formed integrally on the plug-in sleeve 10 by way of two axial cutouts 25 in each case.

At their free ends, the spring arms 7 have inwardly projecting latching protrusions 5 which form undercut latching steps. The latching steps are oriented toward the inside of the cavity. The latching protrusions 5 form control slopes 11 which are directed toward the inside of the cavity. In their normal position, the latching protrusions 5 project into the plug-in sleeve 10 in order to engage behind the periphery of an annular recess 16 of a blade 4, so that the blade 4 is arrested in the plug-in opening 3 of the plug-in sleeve 10.

The spring arms 7 can be flexed by a trigger 6. The trigger 6 is formed by the abovementioned annular body 12. The latter is seated in front of the end surface 1' of the handle 1 and has a hexagonal through-opening 13 through which the blade 4 projects.

The annular body 12 incorporates control elements 8. These are formed by crosspieces which project into the cavity 9. In the latching position, these control elements 8 are located in front of the control slopes 11. If the annular body 12 is forced axially in the direction of the handle 1, then the latching protrusion 5 can penetrate into an associated escape recess of the cavity. The control elements 8 here slide along the control slopes 11 and drive the spring arms 7 into the escape spaces 22, which are disposed behind the spring arms 7. This escape movement of the spring arms 7 is accompanied by the latching protrusions 5 being moved out of the annular recess 16. The blade 4 can thus be removed from the plug-in opening 3.

If the annular body 12 is released again, then the spring arms 7 spring back again into their starting position. The control element 8 here slides along the control slope 11, so that the annular body 12 is also displaced back into its starting position again.

In this starting position, the annular body 12 is retained by the hooks 23 of the retaining arms 14, these hooks being located in front of the respective retaining steps 21.

In the exemplary embodiment, the blade has a metallic core 18 which is sheathed by a plastics-material coating 17. With the exception of the tip of the screwing tool, the entire core 18 is sheathed with a plastics-material coating. The core 18 is of non-round configuration in the portion designated 4', so that, in this region 4', a torque can be transmitted to the tip-forming steel core 18.

The plastics-material sheath 17 enclosing the core 18 has a hexagonal profile corresponding to the hexagonal profile of the plug-in opening 13. The plastics-material sheath 17 incorporates the annular recess 16, in which the undercut latching protrusion 5 can engage.

That end surface of the blade 4 which is sheathed in plastics material is supported on the base of the cavity 9.

Figure 6:
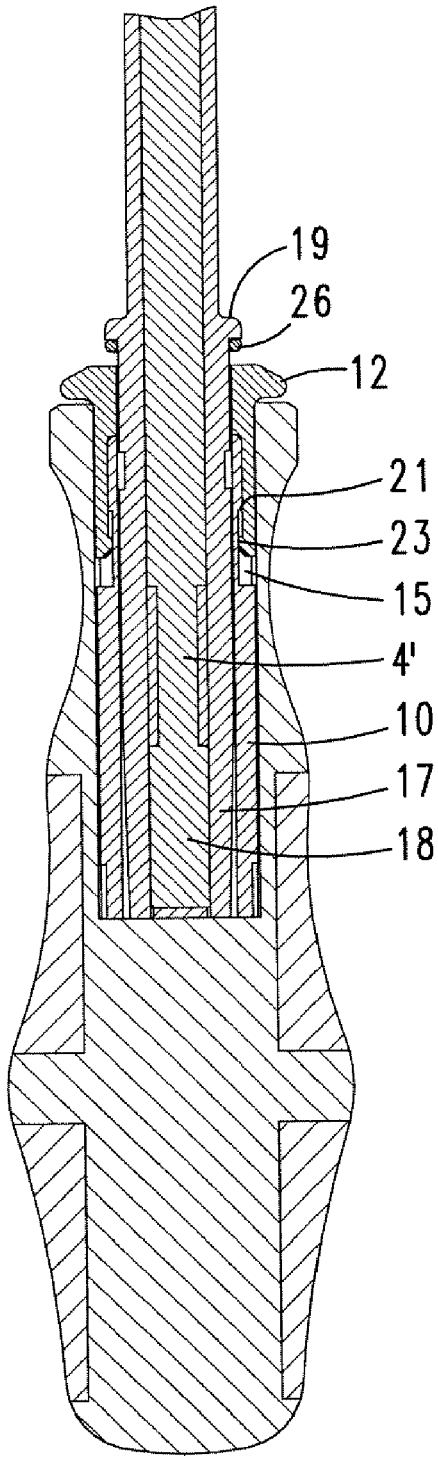
FIG. 6 shows an illustration according to FIG. 4 in the release position, an O-ring disposed between the collar 19 and end surface of an annular body 12 being depicted in addition.
Figure 7:
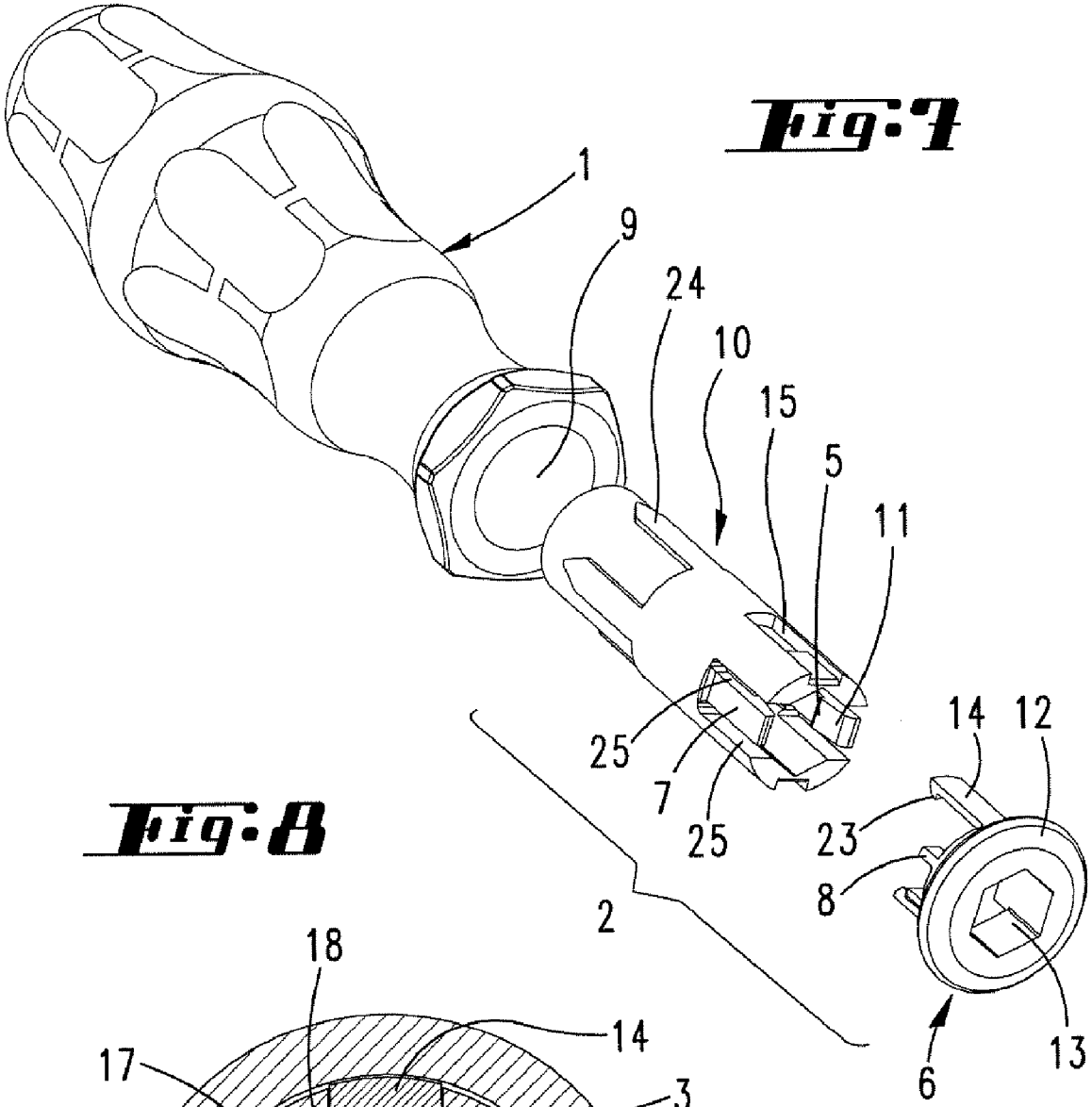
FIG. 7 shows an exploded illustration, in perspective, of the handle.
Figure 8:
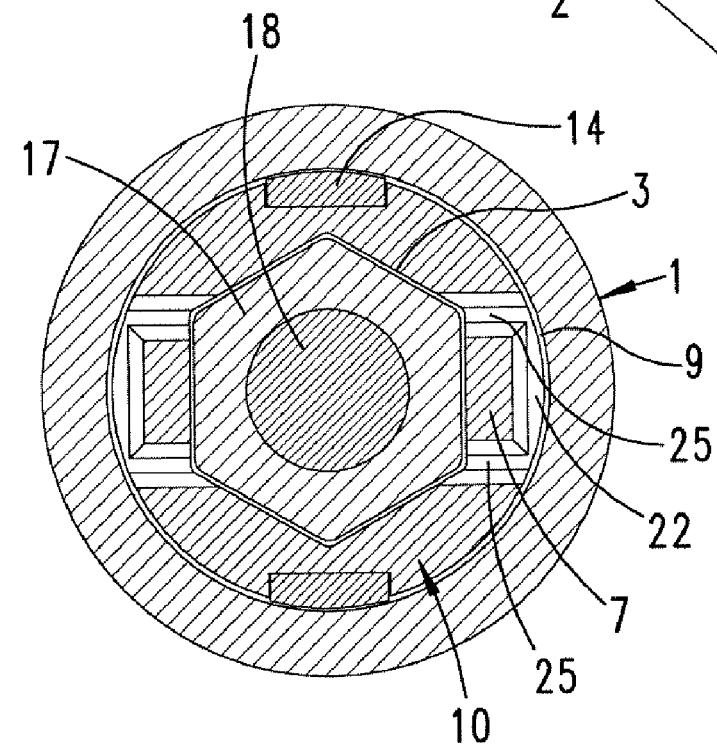
FIG. 8 shows a cross-section along line VI-VI in FIG. 3.

FIG. 6 additionally depicts an O-ring 26, which butts against a step formed by a collar 19 of the plastics-material sheath 17. The O-ring 26, then, is located between the collar 19 and that end surface of the annular body 12 which is oriented in the direction of the screwing-tool tip.

The diameter of the annular body 12, of which the outline is in the form of a circular ring, is smaller than the diameter of the end surface 1' of the handle, this end surface having a hexagonal outline and thus forming a rolling-prevention means.

If the blade 4 plugged into the chuck is subjected to pulling forces, then these are directed into the spring arms 7. The spring arms 7 here are subjected to pulling stressing.

All features disclosed are (in themselves) pertinent to the invention. The disclosure content of the associated/attached priority documents (copy of the prior application) is hereby also included in full in the disclosure of the application, also for the purpose of incorporating features of these documents in claims of the present application.

What is claimed is:

1. A tool, comprising a handle with a chuck, a blade which can be plugged into a plug-in opening of the chuck, the blade removably plugged into the plug-in opening by being retained by a catch of the chuck, the catch has a latching protrusion which is disposed on a spring arm, the spring arm extending in the axial direction of the plug-in opening and along the periphery of the opening, and the latching protrusion is displaced from the latching position into the release position by a control element of an axially displaceable trigger; and the control element is an axial extension of an annular body which has a through-opening for the blade and is associated with the end side of the handle.

2. The tool according to claim 1, characterized in that the plug-in opening is formed by a plug-in sleeve disposed in a cavity of the handle.

3. The tool according to claim 1, characterized in that a plug-in sleeve is produced from plastics material and the spring arm is associated integrally with the plug-in sleeve.

4. The tool according to claim 1, characterized in that the spring arm has a slope which interacts with the control element.

5. The tool according to claim 1, characterized in that the control element is an axial extension of an annular body which, having a through-opening for the blade, is associated with an end side of the handle.

6. The tool according to claim 1, characterized in that an annular body has retaining arms which project into a retaining passageway of the plug-in sleeve.

7. The tool according to claim 1, characterized in that a radially outwardly oriented passageway wall is formed by a handle cavity.

8. The tool according to claim 1, characterized in that an annular body is forced into a forward position by the force of the spring arm.

9. The tool according to claim 1, characterized in that the latching protrusion engages a recess of the blade.

10. The tool according to claim 1, characterized in that the blade has a plastics-material sheath which incorporates a recess.

11. The tool according to claim 1, characterized by a latching recess disposed in annular form in a plastics-material sheath.

12. The tool according to claim 1, characterized in that an annular body consists of plastics material.

13. The tool according to claim 1, characterized by a collar which is associated with the blade and, in the plugged-in state, is located in front of an annular body.

14. The tool according to claim 1, characterized by an O-ring located between a collar and an end side of an annular body.

15. The tool according to claim 1, wherein the handle, the chuck, the trigger, and a plug-in sleeve consist exclusively of an insulating material.

* * * * *